United States Patent [19]

Krautzberger, deceased

[11] Patent Number: 4,738,877

[45] Date of Patent: Apr. 19, 1988

[54] APPARATUS FOR COATING MOVING STRIPS OF MATERIAL

[75] Inventor: Franz Krautzberger, deceased, late of Groszkuchen, Fed. Rep. of Germany, by Anni Kratzberger, executor

[73] Assignee: J. M. Voith, GmbH, Heidenheim, Fed. Rep. of Germany

[21] Appl. No.: 27,178

[22] Filed: Mar. 18, 1987

[30] Foreign Application Priority Data

Mar. 20, 1986 [DE] Fed. Rep. of Germany ..... 3609383

[51] Int. Cl.[4] ..... B05D 3/12; B05C 11/02

[52] U.S. Cl. ..... 417/356; 15/256.51; 118/123; 118/245; 118/261

[58] Field of Search ..... 15/256.51; 118/123, 118/245, 261; 427/356

[56] References Cited

U.S. PATENT DOCUMENTS 2,565,319 8/1951 Newman ..... 118/200 X 3,113,890 12/1963 Johnson et al. ..... 118/126

3,722,465 3/1973 Krautzberger ..... 118/123

4,637,338 1/1987 Wohrle ..... 118/123 X

*Primary Examiner*—Michael R. Lusignan

*Attorney, Agent, or Firm*—Jeffers, Hoffman & Niewyk

[57] ABSTRACT

A coating material is transferred to the surface of a spreader-roll from a spreader-mechanism. The spreader-roll is partly wrapped by a strip of material. In the location where the said strip of material is lifted off the spreader-roll, a doctor-element, comprising a doctor-blade, is arranged to rest tangentially on the spreader-roll. The doctor-element thereby forms a rubbing distributing surface which faces the strip of material and ensures a smooth and uniform coating of the coating material on the strip of material. The strip of material is then carried away over a sharp tear-off edge on the doctor-element at an angle of less than 20°. In this way a coating of any desired thickness may be applied to a strip of material, more particularly as a coating for a strip of paper.

45 Claims, 2 Drawing Sheets

APPARATUS FOR COATING MOVING STRIPS OF MATERIAL

The present invention relates to an apparatus for coating moving strips of material by transfer from a spreader roll An apparatus of this type is known from U.S. Pat. No. 2,565,319. As described therein, coating material is transferred, by means of a doctor-element, from a spreader-roll to a strip of material carried by a second roll. The thickness of the coating is established, at the moment of transfer, by a coating blade arranged as an extension of the scraping surface of the doctor-element.

One drawback of this prior art system is that it is difficult to transfer the coating material to the strip of material in the desired amount. Another drawback is that an accurate edge can be obtained only with extensive additional measures. The strip of material is also subjected to considerable loading and two rolls are required. On the whole, a considerable capital expenditure on equipment is required.

Apparatus are also known (e.g. according to U.S. Pat. No. 3,113,890) in which the coating material is first applied from the spreader-roll to strip of material carried on a counter-roll and is then scraped by a doctor-element in order to obtain a coating of the desired thickness. Here again it is difficult to transfer the coating material from the spreader-roll to the strip of material in such a manner as to obtain all desired coating weights, and edging is also a problem.

Known from U.S. Pat. No. 3,722,465 is an apparatus for coating moving strips of material in which a doctor-blade is pressed, substantially tangentially, against the roll carrying the strip of material. With this apparatus, however, the coating material already applied to the strip of material is scraped. The strip of material runs in the direction of the edge of coating blade, so that the latter forms the run-out end of the coating blade.

In accordance with the present invention a novel form of apparatus for coating moving strips of material is provided. The coating is achieved by transferring the coating material from a spreader-roll, over a doctor, to the strip of material. The spreader-roll is wrapped by the strip of material over a distance along its coated periphery. A doctor element in the form of a blade or leaf spring is arranged in the notch formed where the strip of material is lifted off the spreader roll. The apex of the doctor element extends tangentially onto the apex of the notch and presses against the spreader roll.

The doctor element has a substantially flat transfer- and rubbing-distributing surface on the side remote from the spreader-roll and running parallel with the strip of material, for the purposes of transferring the doctored coating material to the strip of material. An abruptly falling stripping edge is arranged at the outlet end of the doctor blade running parallel with the axis of rotation of the spreader-roll.

This novel arrangement enables satisfactory coating and good edging to be obtained over a wide range of coating weight at low capital cost.

The present invention also includes a novel method for coating moving strips of material with a coating material by transferring the latter to the strip of material from a spreader-roll by means of a doctor-blade, which comprises: (a) guiding the strip of material over a portion of the periphery of the spreader-roll; (b) scraping a predetermined amount of coating material off the spreader-roll and transferring the scraped material to the strip of material guided along the doctor-blade; and (c) effecting additional regulation of the amount of coating material applied, with a view to increasing the thickness of the coating, by controlling the r.p.m. of the spreader-roll which is immersed in a bath of coating material.

The invention is described further, by way of illustration, with reference to the accompanying drawings, in which.

Figure 2:
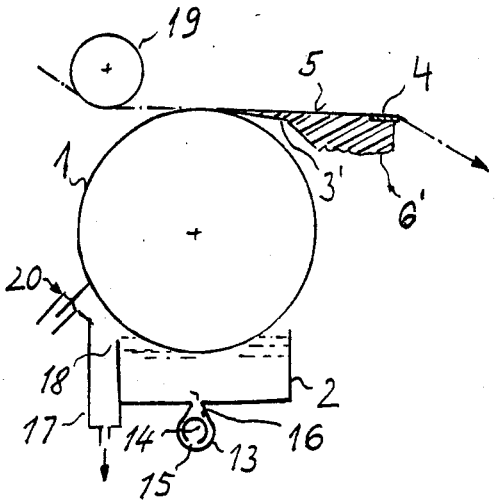
FIG. 2 illustrates schematically a modification of the embodiment of FIG. 1.

In the drawings, a strip of material B is guided over the coated part of a spreader-roll 1 which dips into a bath of coating material contained in a vat 2. Arranged in the vicinity of the notch 11 where the strip of material leaves the spreader roll 1, is a doctor-element 6 with a tip or blade 3. The doctor-element 6 or 6' (FIG. 2), with blade 3 or 3', projects in the direction of the apex of the notch. Located at the other end of doctor-element 6, in the case of FIG. 2, is a stripping rail 4 which is preferably made of steel or a ceramic and has a sharp tear-off edge where the strip of material B leaves the stripping rail 4, the bend-angle of the strip of material B being at the most about 20°. The surface 5 of the doctor-element 3, which faces the strip of material and runs substantially parallel therewith, continues in this case uninterruptedly as far as the surface of stripping rail 4 which also faces the strip of material. Doctor-element 6 or 6', and tip 3' or blade 3 is pressed substantially tangentially against spreader-roll 1 by means of a flexible compression-tube 9. In this way, an amount of coating material corresponding to the pressure applied is scraped from the spreader-roll 1 and is transferred to the strip of material B. This arrangement ensures uniform application at stripping edge 12 of blade 3 or of stripping rail 4.

Doctor-element 6', with blade 3', is preferably made in one piece out of plastic and has a tip which is as sharp as possible and a narrow leading edge, for the purpose of scraping the coating material from spreader-roll 1. As shown in FIG. 2, doctor-element 6' may also serve as a holder for stripping rail 4. Doctor-element 6 is mounted upon a carrier 7, and a flexible compression-tube 9 is arranged between an arm 8 of the carrier and an arm 10 of doctor-element 6. A pivot 22, formed in this case by a leaf-spring 21, is provided at the end of arm 8 for the mobile mounting of doctor-element 6. As shown in dotted lines, a pivot may also be formed by bolts 24 on arms 23 of carrier 7. The spreader-roll 1 is preferably made of metal with a chromium-plated surface, which may be smoothed galvanically.

In order to produce a uniform coating edge, lateral doctors 20 are provided at spreader-roll 1 and these remove the unwanted coating material at the side before transfer to the strip of material B from the spreader-roll 1. In order to ensure a uniform feed of coating material to vat 2, a chamber 13 is provided. The chamber 13 contains a central feed-pipe 14 with an outlet 15. The feed-pipe 14 forms a uniform duct 16, with chamber 13.

By regulating the r.p.m. of the spreader-roll 1, which should be relatively low, the amount of coating material taken up by the roll 1 may be adapted to the amount to be transferred to the strip of material B.

In order to prevent aging of the coating material, an overflow weir 18 and an overflow chamber 17 are connected to vat 2. Any excess material is carried away over the weir 18 in a constant flow.

The time during which the coating material acts may be adjusted, with an adjusting roller 19, by adjustment of the wrap-around angle of the strip of material B on spreader-roll 1. The movement of adjusting roller 19 may be according to the double arrow or around a circular track.

The desired amount of coating material can be transferred to the strip of material B by adjusting the pressure applied by doctor-element 3 as controlled by compression-tube 9. Uniform coating is assured by surface 5 of doctor-element 6 which is parallel with the strip of material B. Finally, smoothness is obtained at the stripping edge of rail 4.

Figure 1:
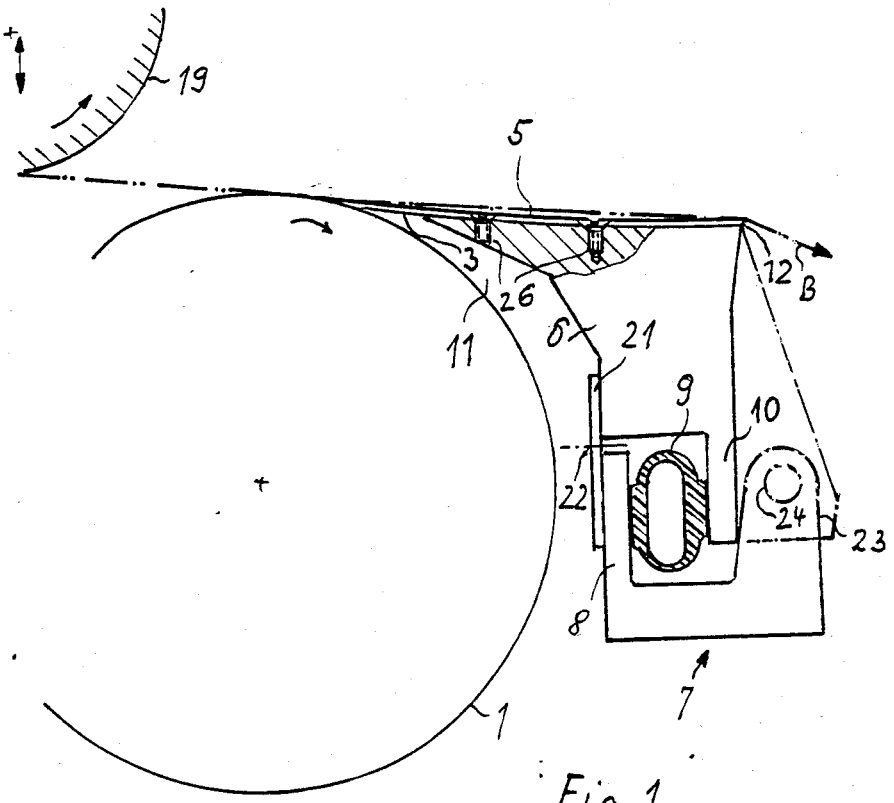
FIG. 1 illustrates schematically one embodiment of the invention.

Surface 5 may, of course also be slightly convex or concave, but the maximal distance between it and the strip of material B should not exceed 2 to 3 times the thickness of the coating, for example, in order to keep irregularities from the heads of screws 26, used to secure doctor-blade 3 to doctor-element 6, away from the coating operation and the coating area. In this case, the doctor-blade itself provides rubbing-distributing surface 5. In FIG. 1, the concave shape is shown in exaggerated manner.

Figure 3:
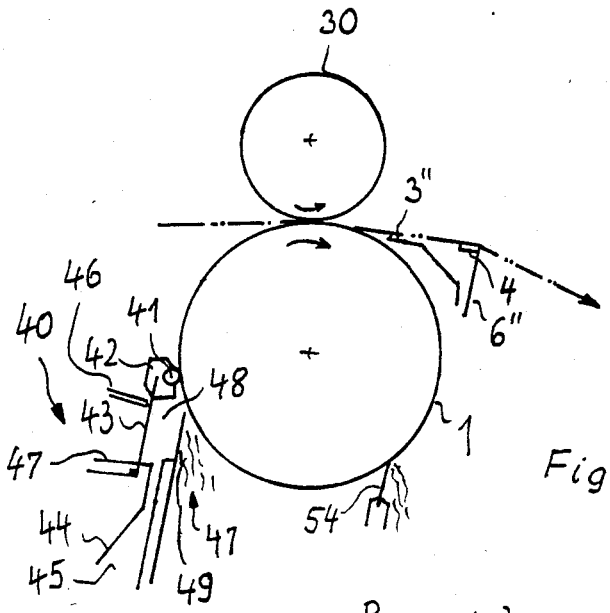
FIG. 3 illustrates schematically another embodiment of the invention.

FIG. 3 shows an arrangement in which a pressure-roll 30 is associated with spreader-roll 1. At the beginning of the wrap-around area on spreader-roll 1, this pressure-roll 30 forms a pressure-gap. With this arrangement, the coating material picked up by the strip of material B to be coated is pressed more strongly into the pores thereof. In this case, a very small excess of coating material is used and this excess, as shown to an enlarged scale in FIG. 4, in the form of a coating 51 remaining on spreader-roll 1, is carried away by doctor-element 6''. By means of an additional doctor-element 54, the excess of coating material may be scraped from the spreader-roll 1 and, after reprocessing, can be returned to the circuit.

In order to achieve very uniform application and control of the coating thickness, it is desirable to use a spreader-mechanism 40 of the type shown in FIG. 3. This mechanism comprises a resilient roller-doctor bed 42, generally made of plastic and carrying roller-doctor 41 The latter is usually driven in a direction opposite to that of the spreader-roll 1 and is preferably provided with peripheral grooves, for example, in the form of a wire helix. Roller-doctor rod 41, together with doctor-bed 42, is held by a leaf-spring 43 which is pressed against a supporting device 44 by means of a pressure-piece 47 and is thus held thereto. The supporting device 44 forms a chamber 45 to which the coating material is fed and from which it flows to roller-doctor rod 41. It is preferable to feed an excess of coating material to chamber 48. This excess may then emerge through a throttle-plate 49, which may also be as thin as a leaf-spring, through a throttle-gap formed with spreader-rod 1 as shown at 47.

Roller-doctor rod 41, together with doctor-bed 42 can be pressed against spreader-roll 1, to varying degrees, by leaf-spring 43 and a pressure-piece 46, or by pivoting supporting device 44 through a specific angle towards the spreader-roll 1.

Figure 4:
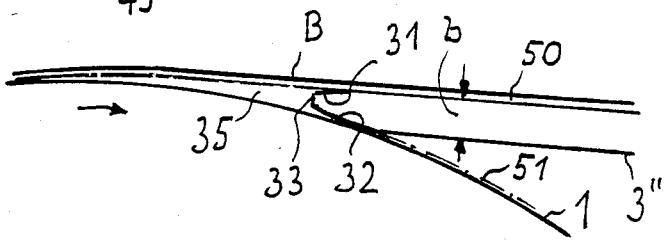
FIG. 4 is a close-up detail of the embodiment of FIG. 3.

FIG. 4 shows more clearly the configuration of doctor-blade 3'' of doctor-element 6''. Formed between strip of material B and front edge 33 of doctor-blade 3'' is a notch or wedge-shaped area which is filled with coating material. Coating material 50 is taken from here to strip of material B. Doctor-blade 3'' is pressed against spreader-roll 1, but only to an extent such that a lubricating film of coating material can form upon lower rounded edge 32. This arrangement substantially reduces wear. An upper rounding off 31 of the front edge of doctor-blade 3'' is also advantageous in feeding the coating material 50 to strip of material B, but it is also possible to operate here with a sharp edge 33. Maximal thickness b in the pointed area of doctor-blade 3'' should not exceed 5 mm and preferably 3 mm. The minimal thickness is preferably between 0.3 and 0.5 mm.

Additional pressure-roller 30 may be used both in connection with spreader-mechanism 40 in FIG. 3 and in connection with vat 2 in FIG. 2.

Modifications are possible within the scope of the invention.

The embodiments of the invention in which an exclusive property or privilege is claimed are defined as follows:

1. An apparatus for coating moving strips of material by transferring the coating material from a spreader-roll, over a doctor, to the strip of material, characterized in that:

(a) over a distance along its coated periphery, the spreader-roll is wrapped by the strip of material and, arranged in the notch formed where the strip of material is lifted off the said spreader-roll, is a doctor-element in the form of a blade or leaf-spring, the apex thereof extending substantially tangentially into the apex of the notch and pressing against said spreader-roll;

(b) the doctor-element exhibits, on the side remote from the spreader-roll, a substantially flat transfer- and rubbing-distributing surface running parallel with the strip of material, for the purpose of transferring the doctored coating material to the strip of material;

(c) arranged at the outlet end of the doctor-element is an abruptly falling stripping edge which runs parallel with the axis of rotation of the spreader-roll.

2. The apparatus of claim 1, wherein at the beginning, or in the area of the spreader-roll which is wrapped with the strip of material, a pressure-roll is provided forming a pressure-gap with the spreader roll.

3. The apparatus of claim 1, wherein the spreader-mechanism for the coating material is in the form of a roller-doctor held by a doctor-bed with rotating peripheral grooves to which the material to be spread is fed in a substantially enclosed space formed at the spreader-roll.

4. The apparatus of claim 1, wherein the doctor-blade is slightly pointed at its run-out edge by an upper and/or a lower straight or curved chamber.

5. The apparatus of claim 2, wherein with a slightly convex or concave transfer-surface, the maximal distance between the central areas of the transfer-surface and the strip of material is, at the most, twice the thickness of the coating after the strip of material has been lifted off the spreader-roll.

6. The apparatus of claim 2, wherein the transfer-surface ends at a stripping edge or merges into the surface of a stripping rail with the stripping edge.

7. The apparatus of claim 3, wherein the doctor-element is made of plastic.

8. The apparatus of claim 6, wherein the stripping rail is made of metal or a ceramic.

9. The apparatus of claim 1, wherein a flexible compression-tube is provided parallel with the stripping edge of a stripping rail, between a doctor-element carrier and a doctor-element, which presses the tip of the doctor to the roll.

10. The apparatus of claim 1, wherein the spreader-roll is chromium-plated.

11. The apparatus of claim 1, wherein the surface of the spreader-roll is smoothed galvanically.

12. The apparatus of claim 1, wherein lateral doctors are provided at the spreader-roll for forming a coating edge.

13. The apparatus of claim 1, wherein the bend-angle of the strip of material at the stripping rail is less than 20°.

14. A method for coating moving strips of material with a coating material by transferring the latter to the strip of material from a spreader-roll by means of a doctor-blade, which comprises:

(a) guiding the strip of material over a portion of the periphery of the spreader-roll;

(b) scraping a predetermined amount of coating material off the spreader-roll and transferring the scraped material to the strip of material guided along the doctor-blade; and (c) effecting additional regulation of the amount of coating material applied, with a view to increasing the thickness of the coating, by controlling the r.p.m. of the spreader-roll which is immersed in a bath of coating material.

15. The apparatus of claim 3 wherein with a slightly convex or concave transfer-surface, the maximal distance between the central areas of the transfer-surface and the strip of material is, at the most, twice the thickness of the coating after the strip of material has been lifted off the spreader-roll.

16. The apparatus of claim 4 wherein with a slightly convex or concave transfer-surface, the maximal distance between the central areas of the transfer-surface and the strip of material is, at the most, twice the thickness of the coating after the strip of material has been lifted off the spreader-roll.

17. The apparatus of claim 3 wherein the transfer-surface ends at a stripping edge or merges into the surface of a stripping rail with the stripping edge.

18. The apparatus of claim 4 wherein the transfer-surface ends at a stripping edge or merges into the surface of a stripping rail with the stripping edge.

19. The apparatus of claim 5 wherein the transfer-surface ends at a stripping edge or merges into the surface of a stripping rail with the stripping edge.

20. The apparatus of claim 4 wherein the doctor-element is made of plastic.

21. The apparatus of claim 5 wherein the doctor-element is made of plastic.

22. The apparatus of claim 6 wherein the doctor-element is made of plastic.

23. The apparatus of claim 4 wherein the stripping rail is made of metal or a ceramic.

24. The apparatus of claim 5 wherein the stripping rail is made of metal or a ceramic.

25. The apparatus of claim 7 wherein the stripping rail is made of metal or a ceramic.

26. The apparatus of claim 4 wherein a flexible compression-tube is provided parallel with the stripping edge of a stripping rail, between a doctor-element carrier and a doctor-element, which presses the tip of the doctor to the roll.

27. The apparatus of claim 5 wherein a flexible compression-tube is provided parallel with the stripping edge of a stripping rail, between a doctor-element carrier and a doctor-element, which presses the tip of the doctor to the roll.

28. The apparatus of claim 6 wherein a flexible compression-tube is provided parallel with the stripping edge of a stripping rail, between a doctor-element carrier and a doctor-element, which presses the tip of the doctor to the roll.

29. The apparatus of claim 7 wherein a flexible compression-tube is provided parallel with the stripping edge of a stripping rail, between a doctor-element carrier and a doctor-element, which presses the tip of the doctor to the roll.

30. The apparatus of claim 8 wherein a flexible compression-tube is provided parallel with the stripping edge of a stripping rail, between a doctor-element carrier and a doctor-element, which presses the tip of the doctor to the roll.

31. The apparatus of claim 5 wherein the spreader-roll is chromium-plated.

32. The apparatus of claim 9 wherein the spreader-roll is chromium-plated.

33. The apparatus of claim 5 wherein the surface of the spreader-roll is smoothed galvanically.

34. The apparatus of claim 9 wherein the surface of the spreader-roll is smoothed galvanically.

35. The apparatus of claim 10 wherein the surface of the spreader-roll is smoothed galvanically.

36. The apparatus of claim 4 wherein lateral doctors are provided at the spreader-roll for forming a coating edge.

37. The apparatus of claim 5 wherein lateral doctors are provided at the spreader-roll for forming a coating edge.

38. The apparatus of claim 6 wherein lateral doctors are provided at the spreader-roll for forming a coating edge.

39. The apparatus of claim 7 wherein lateral doctors are provided at the spreader-roll for forming a coating edge.

40. The apparatus of claim 9 wherein lateral doctors are provided at the spreader-roll for forming a coating edge.

41. The apparatus of claim 4 wherein the bend-angle of the strip of material at the strippng rail is less than 20°.

42. The apparatus of claim 5 wherein the bend-angle of the strip of material at the stripping rail is less than 20°.

43. The apparatus of claim 6 wherein the bend-angle of the strip of material at the stripping rail is less than 20°.

44. The apparatus of claim 7 wherein the bend-angle of the strip of material at the stripping rail is less than 20°.

45. The apparatus of claim 9 wherein the bend-angle of the strip of material at the stripping rail is less than 20°.

* * * * *

UNITED STATES PATENT AND TRADEMARK OFFICE

CERTIFICATE OF CORRECTION

PATENT NO. : 4,738,877

DATED : April 19, 1988

INVENTOR(S) : Franz Krautzberger

It is certified that error appears in the above-identified patent and that said Letters Patent is hereby corrected as shown below:

Col. 3, line 62, change "spreader-rod" to --spreader-roll--;
Claim 41, Col. 6, line 54, change "strippng" to --stripping--.

Signed and Sealed this

Sixth Day of September, 1988

*Attest:*

DONALD J. QUIGG

*Attesting Officer*

*Commissioner of Patents and Trademarks*